US012336641B2

(12) United States Patent
Sternlight

(10) Patent No.: US 12,336,641 B2
(45) Date of Patent: Jun. 24, 2025

(54) TRAVEL PILLOW WITH CHIN-SUPPORTING STRUCTURE

(71) Applicant: Azurous, Inc., Woodland Hills, CA (US)

(72) Inventor: David Sternlight, Woodland Hills, CA (US)

(73) Assignee: Azurous, Inc., Woodland Hills, CA (US)

( * ) Notice: Subject to any disclaimer, the term of this patent is extended or adjusted under 35 U.S.C. 154(b) by 21 days.

(21) Appl. No.: 17/987,068

(22) Filed: Nov. 15, 2022

(65) Prior Publication Data

US 2024/0049884 A1 Feb. 15, 2024

Related U.S. Application Data

(60) Provisional application No. 63/397,054, filed on Aug. 11, 2022.

(51) Int. Cl.
*A47C 7/38* (2006.01)

(52) U.S. Cl.
CPC ..... *A47C 7/383* (2013.01)

(58) Field of Classification Search
CPC ..... A47C 7/383
USPC ..... 297/392, 393
See application file for complete search history.

(56) References Cited

U.S. PATENT DOCUMENTS

| | | | | |
|---|---|---|---|---|
| 10,178,915 | B1 * | 1/2019 | Sternlight | A47C 21/026 |
| 11,419,441 | B2 * | 8/2022 | Waldeier | A47G 9/1045 |
| 2012/0011655 | A1 * | 1/2012 | Rojas | A47C 7/383 5/636 |
| 2014/0310877 | A1 * | 10/2014 | Sternlight | A47G 9/02 5/639 |
| 2015/0257555 | A1 | 9/2015 | Wong | |
| 2017/0251813 | A1 * | 9/2017 | Komsky | A47C 7/383 |
| 2019/0090650 | A1 | 3/2019 | Sternlight et al. | |

FOREIGN PATENT DOCUMENTS

| | | | | |
|---|---|---|---|---|
| CN | 206443520 U * | 8/2017 | | A47C 7/383 |
| DE | 202019004477 U1 * | 3/2021 | | A47C 7/383 |

OTHER PUBLICATIONS

Extended European Search Report for EP 23190535 completed on Dec. 6, 2023.

* cited by examiner

*Primary Examiner* — Milton Nelson, Jr.
(74) *Attorney, Agent, or Firm* — Dennemeyer & Associates LLC

(57) ABSTRACT

Travel pillows including a chin-supporting strap. The travel pillow includes a travel pillow body formed by a back portion and two opposite lobe portions extending from the back portion. A chin-supporting strap is attachable to a surface of one of the lobes. The strap is configured to extend from the lobe over a gap between the ends of the lobes to attach to an attachment region on the lobe opposite the lobe to which the strap is affixed.

17 Claims, 7 Drawing Sheets

TRAVEL PILLOW WITH CHIN-SUPPORTING STRUCTURE

CLAIM OF PRIORITY AND INCORPORATION BY REFERENCE

This application claims the priority of U.S. Provisional Patent Application No. 63/397,054 titles TRAVEL PILLOW WITH CHIN-SUPPORTING STRUCTURE, filed on Aug. 11, 2022, the contents of which are incorporated by reference herein in its entirety.

The following disclosures are hereby incorporated by reference in their entirety:

1. U.S. patent application Ser. No. 16/782,900, filed on Feb. 5, 2020, now U.S. Pat. No. 10,869,557;
2. U.S. patent application Ser. No. 15/465,441, filed on Mar. 21, 2017, now U.S. Pat. No. 11,129,478;
3. U.S. Design Pat. application No. D/622,760, filed on Oct. 19, 2017, now U.S. Pat. No. D899,812;
4. U.S. patent application Ser. No. 16/200,513, filed on Nov. 26, 2018, now U.S. Pat. No. 10,617,220;
5. U.S. patent application Ser. No. 15/348,742, filed on Nov. 10, 2016, now U.S. Pat. No. 10,383,465;
6. U.S. patent application Ser. No. 15/904,400, filed on Feb. 25, 2018, now U.S. Pat. No. 10,178,915;
7. U.S. patent application Ser. No. 15/278,756, filed on Sep. 28, 2016, now U.S. Pat. No. 10,702,082;
8. U.S. patent application Ser. No. 15/278,756, filed on Sep. 28, 2016, now U.S. Pat. No. 10,617,220;
9. U.S. patent application Ser. No. 13/488,443, filed on Jun. 4, 2012, now U.S. Pat. No. 9,635,962
10. U.S. Provisional Patent Application No. 62/531,278, filed on Jul. 11, 2017;
11. U.S. patent application Ser. No. 14/394,259, filed on Apr. 8, 2013, now U.S. Pat. No. 9,526,360;
12. U.S. Provisional Patent Application No. 62/571,785, filed on Oct. 12, 2017;
13. U.S. Provisional Patent Application No. 62/574,366, filed on Oct. 19, 2017.

BACKGROUND

This disclosure relates generally to travel pillows and cushions, and more particularly to travel pillows and cushions including features for supporting the user's chin.

Travel pillows are used by airplane travelers and others in order to provide support to a user's neck and head. While many prior art travel pillows provide support for a user's head, they do not prevent the user's head from falling forward. Travel pillows are typically formed as U-shaped members having a cushion suitable for supporting the user's head, but soft enough to provide a measure of comfort. The U-shaped member may have two portions extending along the sides of the user's head and the portions may be joined either in the back by a back member, or in the front with a front member. Pillows with a front member jointing the side portions may provide some forward motion support for the user. However, such pillows tend to be uncomfortable for many users by providing pressure to the user's throat or simply pressing upwards on the user's chin. Some travel pillows having a back member to join the side portions teach bringing the front ends of the side portions together to provide a chin support. In many cases, the effect is either, similar to that of using a front member to support the chin, or the bringing together of the fronts of the side portions may simply not provide sufficient support for the user's chin.

SUMMARY

The present disclosure is generally directed to travel pillows including a chin-supporting strap. In one aspect, the travel pillow includes a substantially U-shaped pillow body having a foam core and comprising two lobe portions spaced apart by a back portion connected at back-ends of the two lobe portions. Each lobe portion includes an outer surface and a front surface opposite the back portion. A chin-supporting strap is affixed at an affixing portion on one of the two lobes. The chin-supporting strap extends to an opposite end having a strap attachment mechanism. The strap attachment mechanism is configured to mate with an attachment mechanism on the other lobe such that when the chin-supporting strap is extended to the lobe opposite the lobe to which the strap is attached to the opposite lobe to support a user's head at the user's chin.

DETAILED DESCRIPTION

Figure 1:
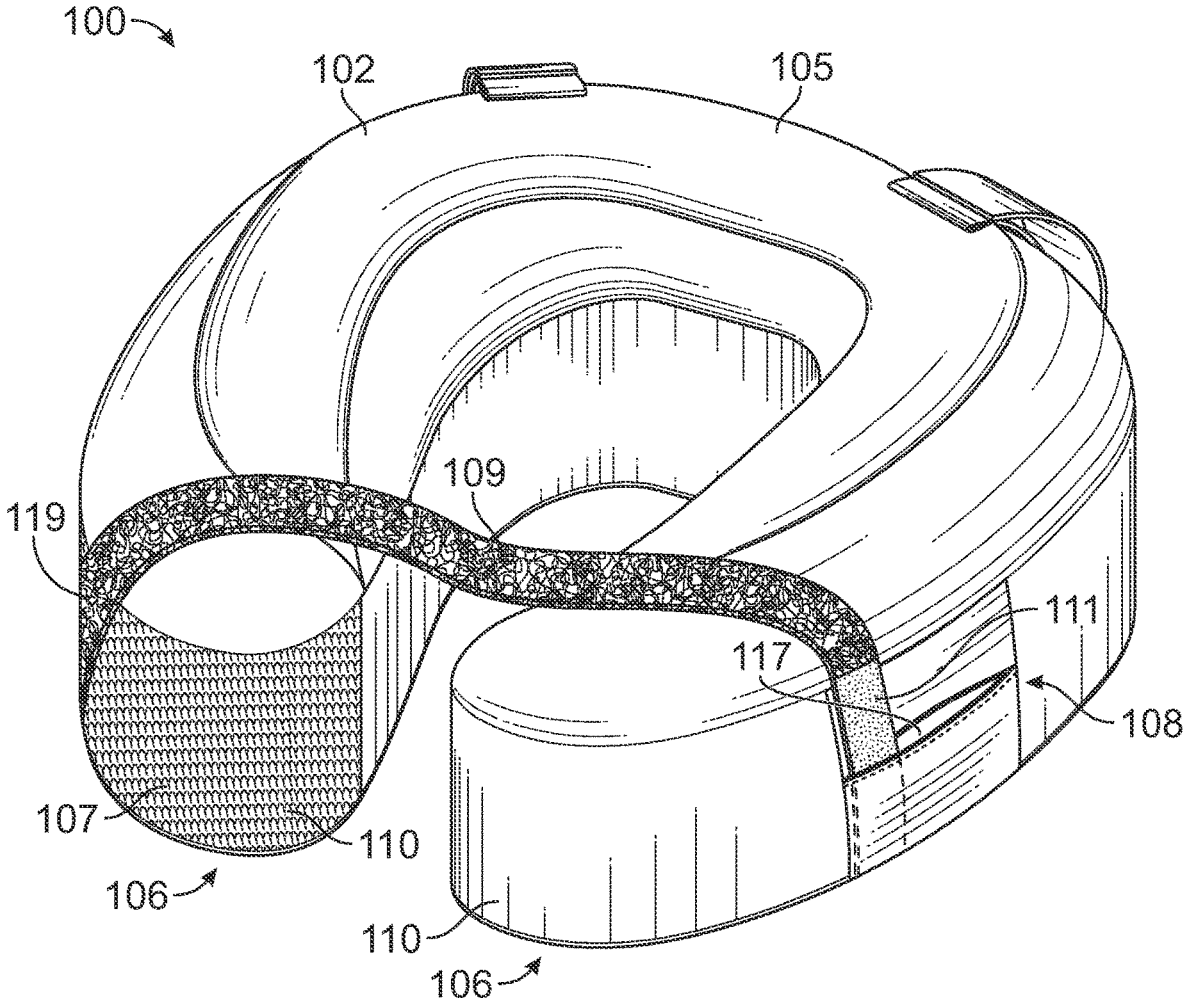
FIG. 1 is a front isometric view of one example implementation of a travel pillow.

The present disclosure describes travel pillows that include a chin-supporting mechanism. The chin-supporting mechanism functions to prevent or make less likely a user's head falling forward, and to limit the motion of the user's head when momentum causes the user's head to jolt in a forward motion. The chin-supporting mechanism may be implemented in the form of a strap affixed at a portion towards a front end of one of the two lobes forming the travel pillow; the lobes extending from a back portion of the travel pillow. The chin-supporting mechanism, or chin-supporting strap for purposes of providing clarity in this disclosure, may extend from the affixing portion of the lobe over a gap between the lobes of the travel pillow to attach in an area on the other lobe of the travel pillow.

The area of attachment on the other lobe of the travel pillow may take many forms dependent on the type of attachment mechanism used for securing the other end of the chin-supporting strap to the other lobe. In examples illustrated in this disclosure, the strap may be attached to the lobe opposite the affixing portion using a hook and loop fastening surface (e.g. Velcro™) on the strap and a mating hook and loop surface on the opposite lobe. Alternative example implementations may use other attachment mechanisms such as a buckle mechanism, buttons, and other types of attachment mechanisms suitable for attaching the chin-supporting mechanism from one lobe to the other lobe while providing a bridging structure between the lobes sufficient to support a user's chin. It is noted that while the figures and specification describe implementations that teach using a hook and loop mechanism for attachment, the invention is not to be limited to hook and loop implementations. Those of ordinary skill in the art will understand how to implement other forms of attachment, and will further understand that such alternative forms of attachment are alternative implementations of the travel pillow with a chin-supporting mechanism.

The present disclosure references certain configurations with alternative implementations in addition to the attachment mechanism, but it is understood that the disclosure may be embodied in many different forms and should not be construed as limited to the configurations set forth herein. The devices and elements herein may have different shapes and sizes beyond those shown. It is also understood that when a feature or element, such as a layer, region, case, cover, frame, or otherwise may be referred to as being "on" another element, it can be directly on the other element or intervening elements may also be present. Furthermore, relative terms such as "inner," "outer," "upper," "above," "lower," "beneath," and "below," and similar terms may be used herein to describe a relationship of one element to another. It is understood that these terms are intended to encompass different orientations of the device in addition to the orientation depicted in the figures.

Although the terms first, second, etc. may be used herein to describe various, e.g., elements, components, regions, layers and/or sections, these elements, components, regions, layers and/or sections should not be limited by these terms. These terms are only used to distinguish one element, component, region, layer, or section from another element, component, region, layer, or section. Thus, a first element, component, region, layer, or section discussed below could be termed a second element, component, region, layer, or section without departing from the teachings of the disclosure.

FIGS. 1-8 show views of example implementations of a travel pillow 100 having a chin-supporting mechanism 109. The travel pillow 100 comprises a travel pillow body 102 that can include a cover 103 that partially or fully covers a core therein, such as a memory foam core. In some configurations, the travel pillow body 102 does not have a cover 103. The travel pillow body 102 may be substantially U-shaped as illustrated in FIG. 1 and include a back portion 105 connected at back ends of two lobe portions 106. The shapes shown by the figures in the present disclosure can be the shape of a body with the cover, or without the cover (e.g., the shape of a memory foam core). The travel pillow body 102 may include a substantially flat rear wall 104 and an anchoring mechanism 112 for attaching the travel pillow 100 to, for example, a headrest on the seat of an airplane. It is to be understood that the shape of the pillow may be different from that of the travel pillow 100 depicted in the figures. In addition, the anchoring mechanisms 112 shown in the figures and described below are optional.

FIG. 1 is a front isometric view of an example implementation of the travel pillow 100. The travel pillow 100 includes a strap affixed at a strap affixing portion 111 on an outer surface 108 of one of the lobes 106. The strap 109 extends from the strap affixing portion 111 over the lobe 106 to which the strap is affixed and over a gap between the front ends of the lobes 106. The travel pillow 100 may include a pocket 117 on the outer surface 108 of the lobe 106 to which the strap is affixed. The strap affixing portion 111 may be positioned within the pocket 117 as shown in FIG. 1. It is noted that the pocket 117 is optional. If included, the strap affixing portion 111 may be positioned on any suitable location on the outer surface 108 of the travel pillow 100.

The lobe 106 opposite the lobe 106 to which the strap 109 is affixed may include a strap attachment portion 107 to receive a free end of the strap 109. The user may place the travel pillow 100 around the back of the user's neck so that the lobes 106 extend from the back portion 105 along the sides of the user's head. The user may extend the strap 109 over the ends of the lobes 106 and under the user's chin and attach the end of the strap 109 to the strap attachment portion 107 the lobe 106 opposite the lobe 106 to which the strap 109 is affixed.

The strap 109 helps limit the forward motion of the user's head during a sudden stoppage of motion or when the user begins to doze off. Limiting the forward motion of the user's head when the user is dozing off to sleep may protect the user from subsequent head or neck pain that might ensue if the user's head was left to hang forward. The strap 109 plus the form of the travel pillow body 102 may provide the user with head support around the user's head.

It is noted that the strap affixing portion 111 is optional as the strap 109 may not be affixed in alternative implementations. The strap 109 in such implementations may be completely detachable from the pillow and be configured to be removably attachable at the ends of the strap 109. In other implementations, the strap 109 may be configured as a separate component and attach to the pillow via removably attachable portions at both ends. The strap 109 may remain separate, or attach via a cord, or attachment strap affixed to the strap 109 and to the pillow to keep the strap 109 attached to the pillow. Removable attachment mechanisms may be added to the cord or attachment strap connecting the strap 109 to the pillow to allow for selective detachment of the strap 109 from the pillow.

It is further noted that the strap 109 is not limited to the precise form shown in the figures. For example, the strap 109 may have a width that allows the strap to cover substantially more or less of the gap between the lobes. In one example implementation, the strap 109 may have a width that allows the strap 109 to extend forward from the user's chin to cover a substantial amount of the gap between the lobes when in use.

Figure 2:
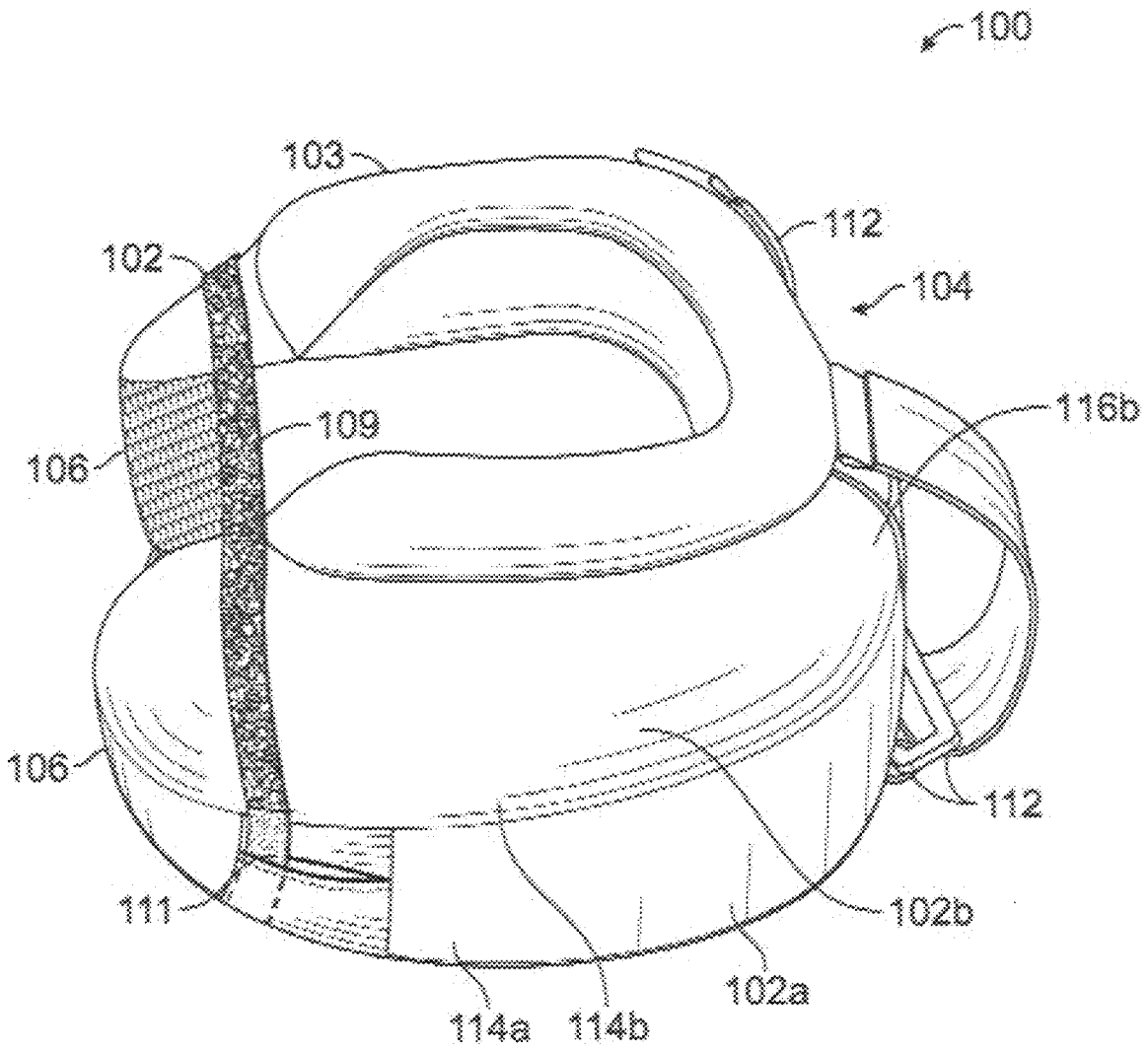
FIG. 2 is a left side isometric view of the travel pillow shown in FIG. 1.
Figure 4:
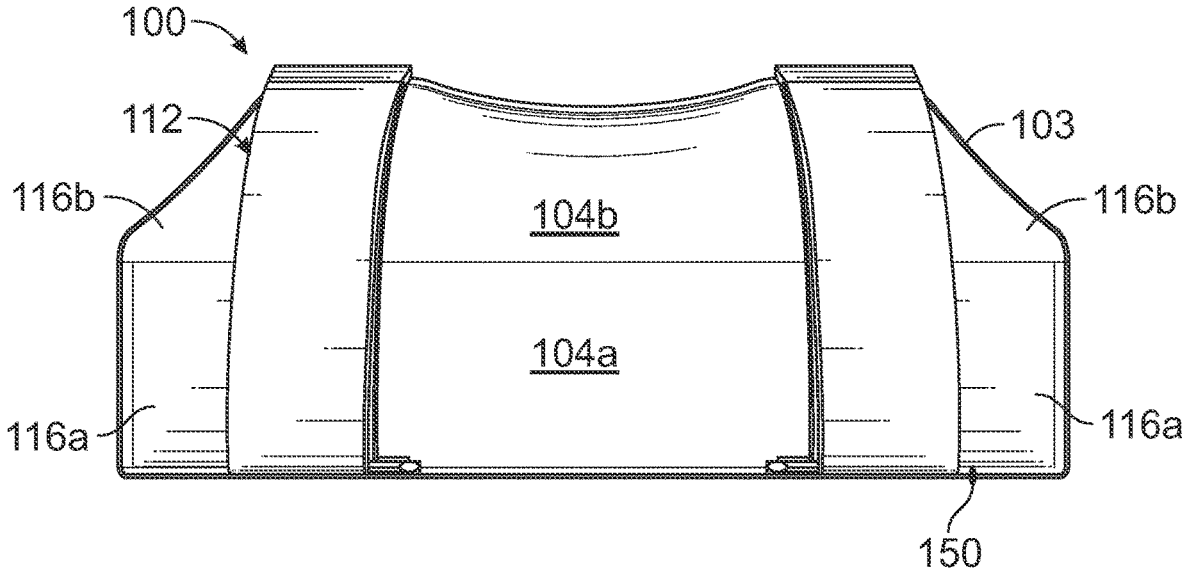
FIG. 4 is a rear view of the travel pillow shown in FIG. 1.

FIG. 2 shows a side isometric view of the pillow 100. The pillow 100 can include base and raised portions or cushions 102*a*, 102*b* (referred to herein as "portions" for simplicity). As shown in FIG. 4, the base portion 102*a* and raised portion 102*b* can include base and raised rear walls 104*a*, 104*b*, with the substantially flat rear wall of the pillow 100 being formed by part or all of one or both of the base and raised rear walls 104*a*, 104*b*. In one configuration, the base and raised rear walls 104*a*, 104*b* are mutually flush and combine to form the substantially flat rear wall 104 of the pillow body 102. The pillow body 102 can include base and raised side walls 114*a*, 114*b*. In some configurations as shown in FIGS. 2 and 4, the pillow body 102 can also include base and raised curved transition walls 116*a*, 116*b* between the base and raised side walls 114*a*, 114*b* and the base and raised rear walls 104*a*, 104*b*. It is understood that while the above discusses base and raised portions of a pillow body, pillow bodies without distinct base and raised portions are possible, including but not limited to pillow bodies that include rear, side, and curved transition walls.

The pillow 100 includes two anchor mechanisms 112 which can serve to anchor the pillow 100 to a headrest, such as to headrest wings. The anchor mechanisms may complement the chin-supporting mechanism 109 by limiting the forward motion of the pillow. The anchor mechanisms 112 can include anchor mechanism bodies 120. Anchor mechanisms 112 according to the present disclosure can include elongated anchor mechanism bodies such as the anchor mechanism bodies 120. For example, the anchor mechanism bodies can be 1" to 24" long, or 2" to 20" long, or 6" to 16" long, or 8" to 14" long, or about 11" long. Anchor mechanism bodies 120 according to the present disclosure can be, for example, 1" to 4" wide, or 4" to 3" wide, or 1" to 2" wide, or about 1.5" wide. The anchor mechanism bodies 120 can be made of many different materials and take many different shapes. The anchor mechanism bodies 120 can be, for example, straps (as shown), cords, strings, ropes, or other flexible, rigid, or non-rigid devices as known in the art. The anchor mechanism bodies 120 can be elastic or inelastic, and can be cloth, cord, string, rope, nylon, poly cord, rubber, polyester, parachute cord, webbing, or other devices and materials as known in the art. In configurations where the anchor mechanism bodies 120 are elastic, they can self-tighten around, for example, a portion of a headrest, to better secure the travel pillow 100 to the headrest.

Figure 7:
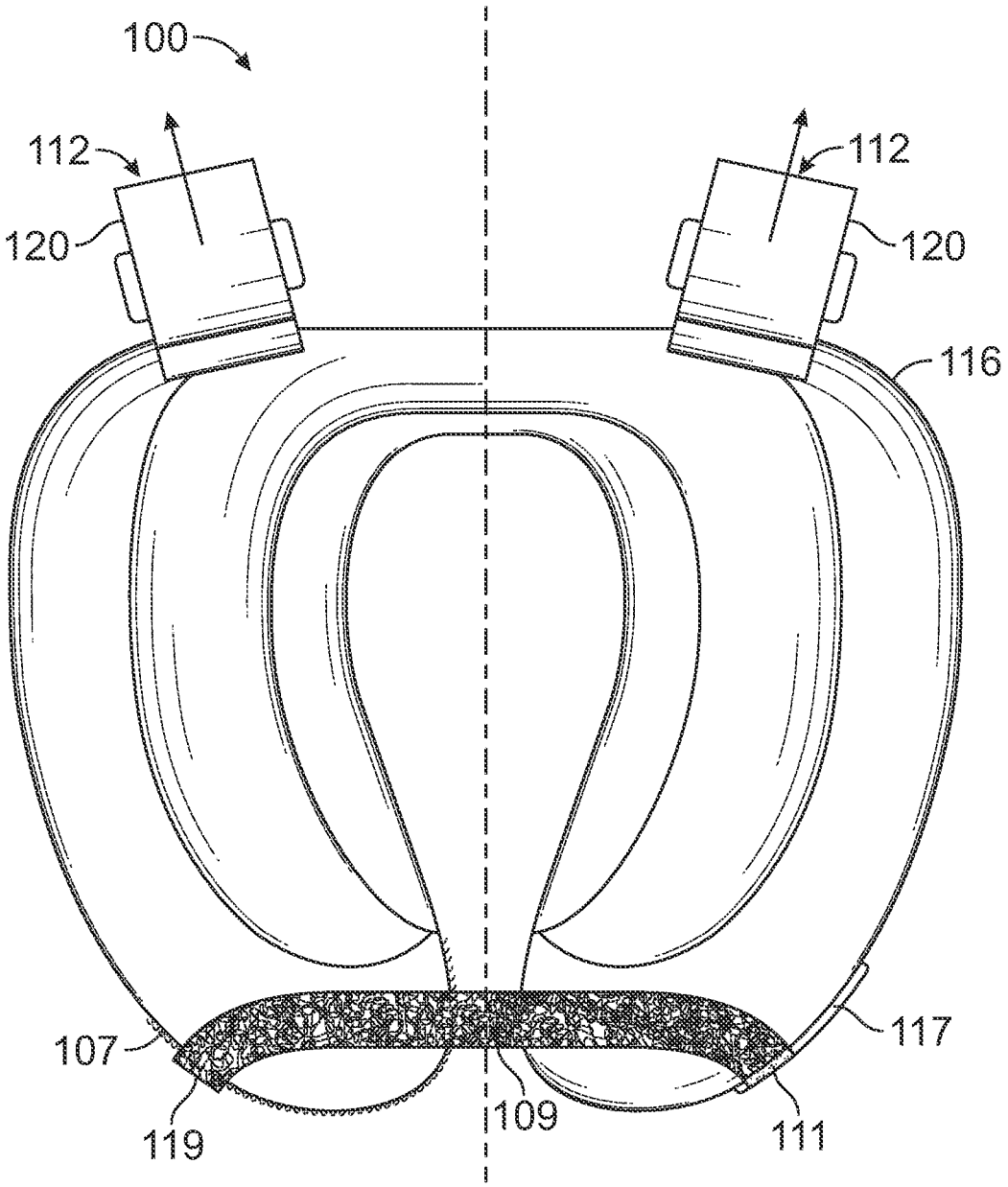
FIG. 7 is a top view of the travel pillow shown in FIG. 1.
Figure 8:
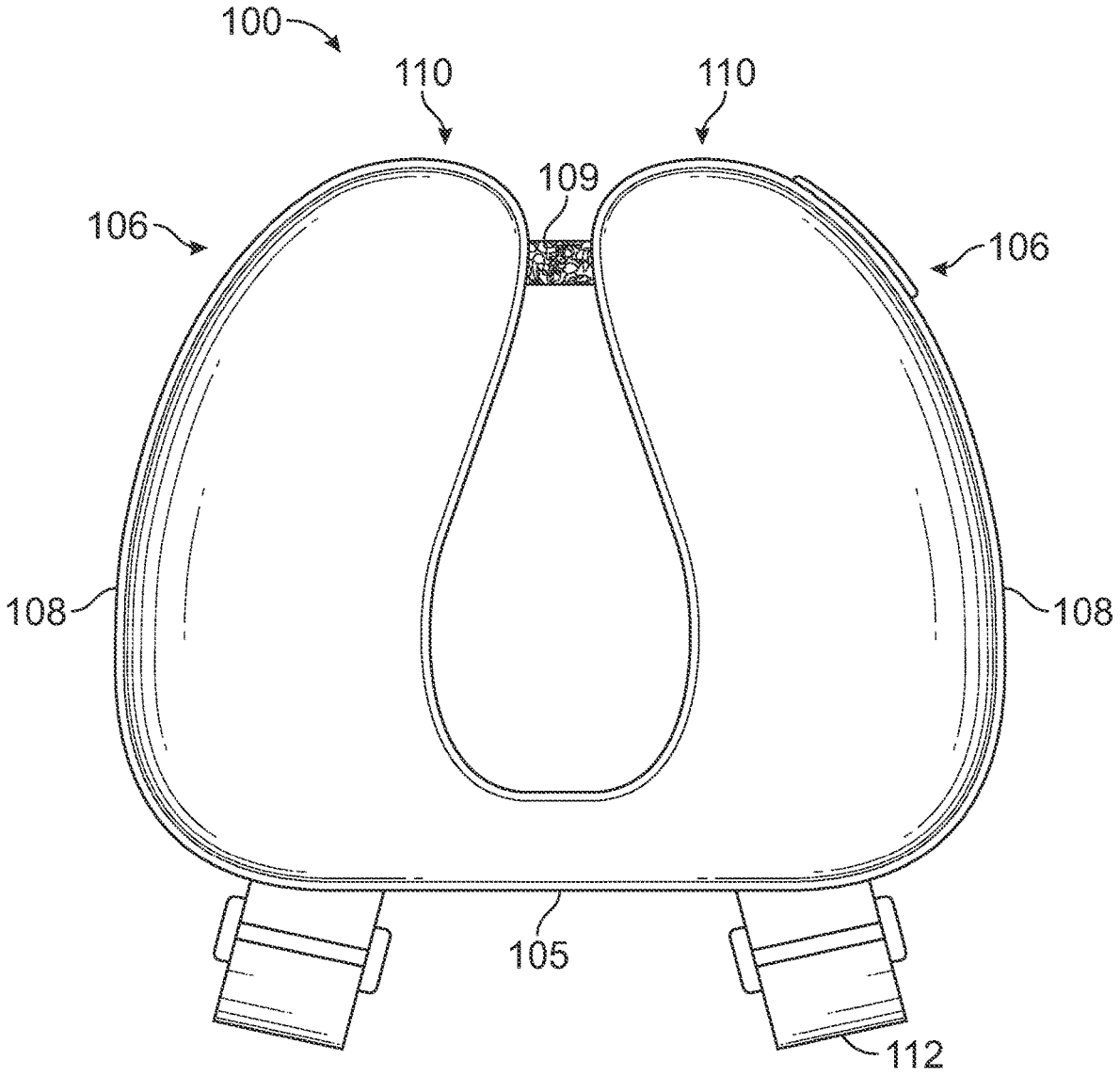
FIG. 8 is a bottom view of the travel pillow shown in FIG. 1.

In the specific configuration shown and as best seen in FIG. 7, the anchor mechanisms 112 are attached in a manner so as to span portions of both 1) the rear walls 104, and 2) the curved transition walls 116, meaning they are attached partially to the rear of the pillow body 102 and partially to the curved transition of the pillow body 102. The anchor mechanisms 112 in the specific configuration shown are angled slightly outward and away from one another (as shown by the arrows in FIG. 7), as opposed to directly rearward (as shown by the axial broken line in FIG. 7). This configuration can be particularly useful for attachment to modern seatback headrest wings. In one configuration, the anchor mechanisms 112 and/or anchor mechanism bodies 120 are attached only to the rear walls 104*a*, 104*b*, and/or are angled substantially directly rearward. In other configurations, the anchor mechanisms 112 and/or anchor mechanism bodies 120 and components thereof are attached only to the base and/or raised curved transition walls 116*a*, 116*b*.

The shape formed by the raised portion 102*b* and raised walls (114*b*, 116*b*) may provide a support to the sides and around the back of the user's head. This helps compliment the support provided by the strap 109 in front of the user's head. It is further noted that the shape formed by the raised portion 102*b* and raised walls 114*b*, 116*b* is optional. The travel pillow 100 may take any suitable shape, which may not include raised portions or raised walls.

Figure 3A:
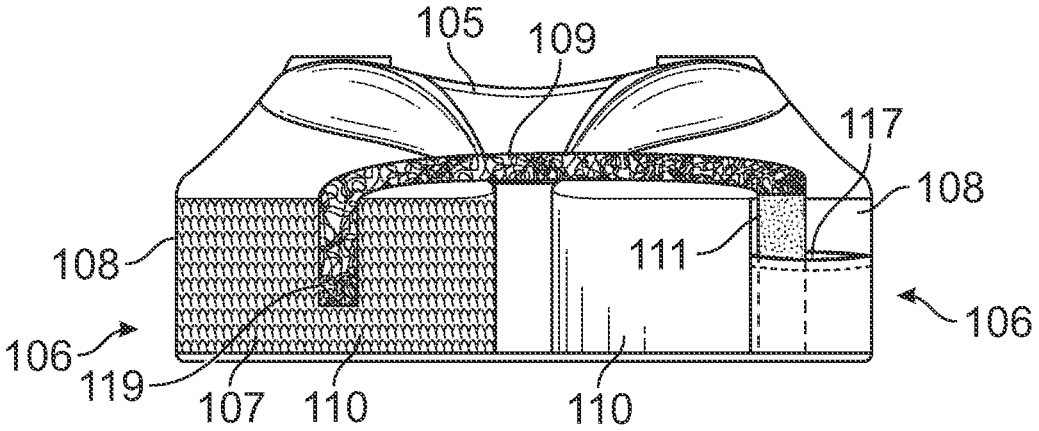
FIGS. 3A-3C are front views of the travel pillow shown in FIG. 1 illustrating a chin-supporting strap in an attached position, a loose position before or after securement, and in a stored position.
Figure 3B:
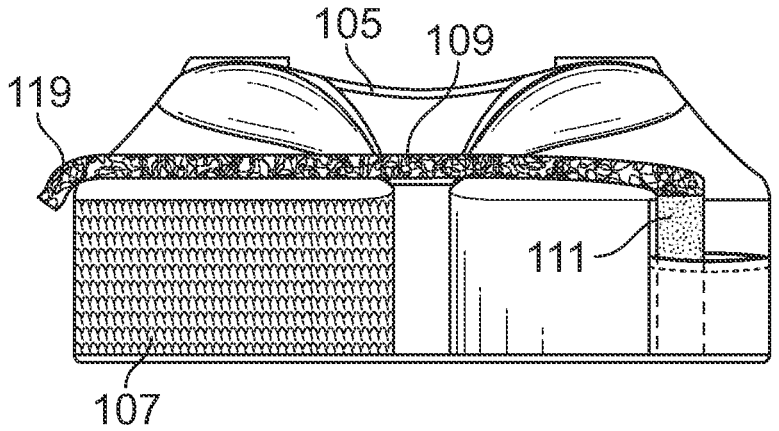
Figure 3C:
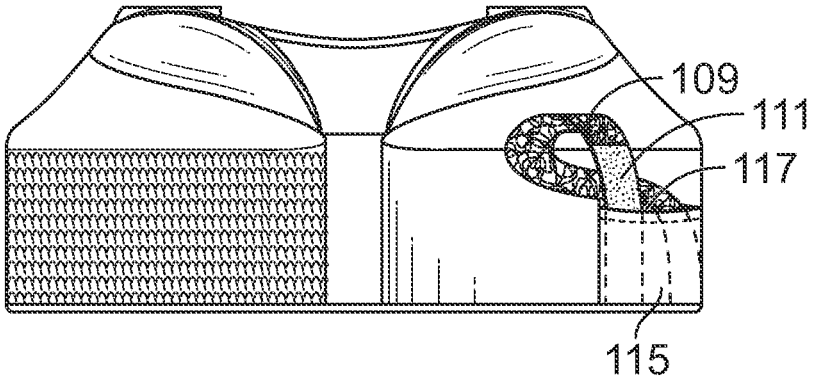
Figure 5:
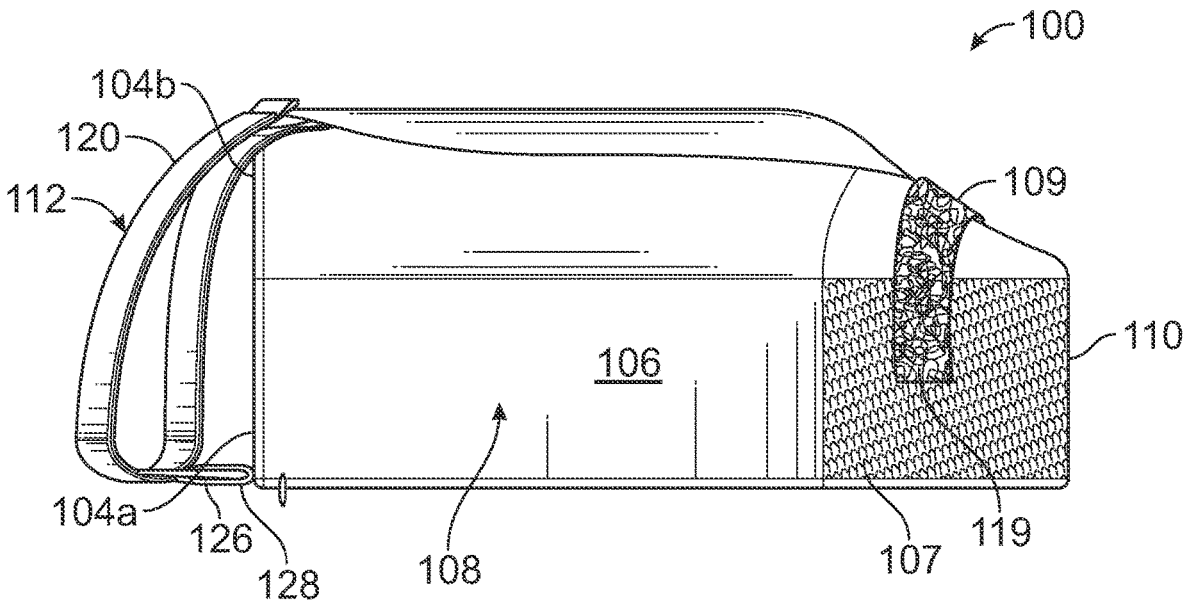
FIG. 5 is a left side view of the travel pillow shown in FIG. 1.

FIGS. 3A, 3B, and 3C are front views of the travel pillow 100 with the strap 109 in different stages of use. FIG. 3A shows the strap 109 in place to support the user's chin. The strap 109 extends over a gap between the lobes 106 in a manner that allows the strap to support the user's chin above the gap. The strap 109 in FIGS. 3A-3C includes a hook and loop surface at a free end 119 of the strap 109. The hook and loop surface attaches to a hook and loop mating surface on the attachment region 107 of the outer surface 108 of the lobe 106 opposite the lobe to which the strap 109 is affixed. FIG. 5 is a right-side view of the travel pillow showing the free end 119 of the strap 109 attached to the attachment region 107 on the lobe 106. The attachment region 107 may extend around the front surface 110 of the lobe 106 as shown in the top view of the pillow 100 in FIG. 7. Alternatively, the attachment region 107 may stop closer to the tip of the front surface 110 of the lobe 106. In some implementations the attachment region 107 may extend to a top surface of the lobe 106.

Figure 6:
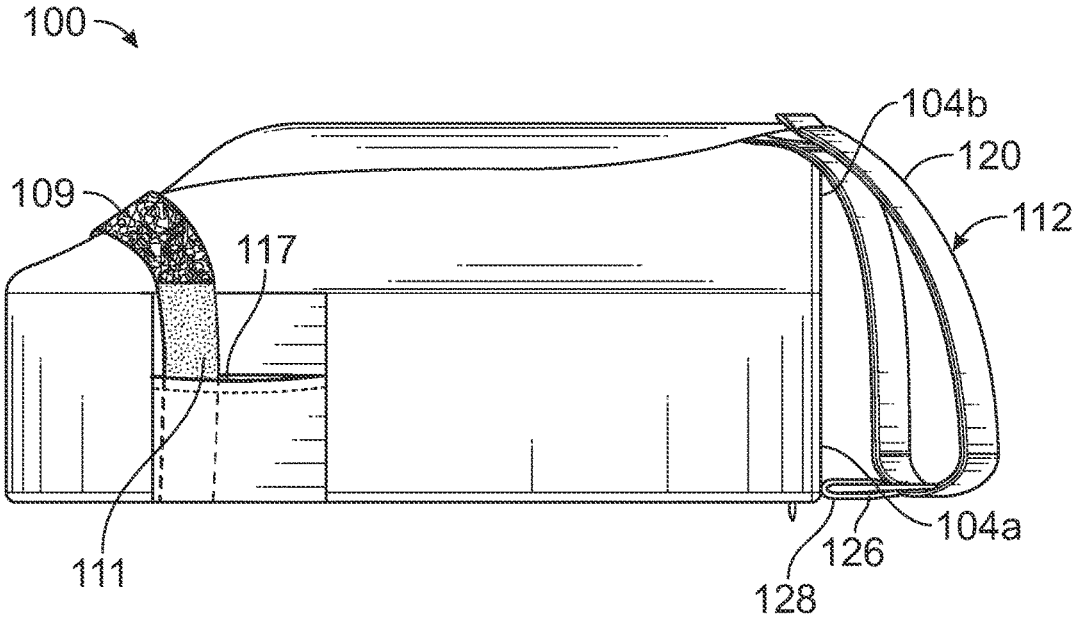
FIG. 6 is a right-side view of the travel pillow shown in FIG. 1.

FIG. 3A also shows the strap 109 affixed to the first lobe 106 at affixing region 111. The strap 109 may be affixed by sowing the strap 109 material on to the outer surface 108 of the pillow body. Other affixing mechanisms may be used as well. FIG. 6 provides a side view of the pillow 100 showing the affixing region 111 extending from the pocket 117. The affixing region 111 is shown extending into the pocket 117, however, the affixing region 111 may be placed in any suitable location relative to the pocket 117. Some implementations may not include the pocket 117.

FIG. 3B shows the strap 109 before or after attachment to the lobe opposite the lobe to which the strap 109 is affixed. FIG. 3C shows the strap 109 tucked in to the pocket 117 when not in use. The strap 109 may be made of any fabric or pliable two-dimensional material that can support a hook and loop surface (e.g. Velcro™) on one side of the strap 109. The material selected for the strap 109 may be soft to provide a layer of comfort for the user's chin while in use. A padding layer may be added to provide further cushioning for the user's chin. The material used for the strap 109 may also have a degree of elasticity to reduce the length required for the strap to reach the opposite lobe 106. The elasticity also reduces the stiffness of the feel of the strap 109 on the user's chin. It provides a little "give" when supporting the chin. The strap 109 may also be made of multiple layers of material to add cushioning properties.

It is noted that the pillow 100 in FIGS. 3A-3C implement the strap 109 with a hook and loop (e.g. Velcro™) attachment mechanism. For example, a male/hook tip surface may be sown onto the underside of strap 109 to secure to a mating loop surface on the attachment region 107 on the other lobe 106. The male/hook tip surface on the strap 109 may be disposed on the strap end 119. In one example implementation, an area at or near a tip of the strap end 119 may be provided with the male/hook tip surface and another area of extending away from the tip of the strap end 119 may be provided with a female/loop surface. This would allow for the male surface portion to be folded over on to the female surface to cover the hook and loop surface on the strap end 119 when it is desired to fit the strap into the pocket 117. In one example, each of the male/hook surface areas and the female/loop surface areas may be 2.5 cm. wide×2.5 cm. long. Those of ordinary skill in the art will appreciate that the dimensions are provided as example only. Any suitable dimensions may be used.

In other implementations, the strap 109 may be provided with a buckle, a buttonhole, or any other suitable attachment mechanism or fastener. A corresponding mating mechanism may be mounted within what is depicted as the attachment region 107 in FIG. 3A.

It is further noted that FIG. 3A shows the strap 109 extending over the top of the lobe 106 opposite the lobe 106 to which the strap is affixed. The user may also choose to extend the strap 109 around the front ends 110 of both lobes 106 to attach to the attachment region 109 when in use to support the user's chin. The ability of the strap 109 to extend around the front of the lobes 110 may accommodate a user having a neck with a larger circumference, or a user that simply prefers this way of attaching the strap 109 and securing the strap 109 to the opposite lobe 106.

Referring to FIGS. 5 and 6, and as mentioned above, the travel pillow 100 can also include connection devices (referred to herein for simplicity as "loops") such as loops 126. The loops 126 can be, for example, D-loops (as shown) or other types of closed loops. Open loops (e.g., a C-shape) are also possible, with the pillow body 102 or another device acting to close the loop (e.g., to form a D-shape or O-shape). In some configurations, the loops 126 are closed loops that can be opened, such as carabiners or similar devices. The loops 126 can be attached directly to the body 102, or alternatively auxiliary connection devices such as the auxiliary connection devices 128 can be used. In the configuration shown, the auxiliary connection devices 128 are stretchable, elastic, and/or non-rigid, whereas the loops 126 are rigid. It is understood that many different configurations are possible. In some other configurations, rigid loops and/or auxiliary connection devices can be used along with detachable anchor mechanism bodies.

The travel pillow 103 may include a cover as described above. The cover 103 can include a pocket 117, which may be used to hold the strap when not in use. The pocket 117 may also be opened and closed using a zipper mechanism. Other types of attachment mechanisms can be used to open and close the pocket 117 including, but not limited to, hook-and-loop fasteners such as those provided by Velcro®, buttons, snaps, adhesives, and laces, to name a few. The pocket 117 and zipper mechanism can be part of the cover 103. In example implementations, the zipper mechanism may be positioned approximately along the junction between the base portion 102*a* and the raised portion 102*b*, and is shown as approximately horizontal. Other placements and orientations are possible. In some configurations, the zipper mechanism 110 is below the junction between the base portion 102*a* and the raised portion 102*b*. In other configurations, the zipper mechanism 110 is above the junction between the base portion 102*a* and the raised portion 102*b*. The pocket 117 can hold a user's goods, such as a mobile phone, keys, earplugs, and/or earbuds. In some configurations, the pillow 100 has multiple pockets. In other configurations, the pillow 100 has no pocket. In some configurations the pillow has one or more pockets without a zipper mechanism 110. In some configurations, the pocket 117 has dividers and/or sub-compartments within the pocket 117.

Additionally, the cover 103 can also include a zipper to allow access to a core of the pillow body 102. For instance, as best seen in FIG. 4, the cover 103 can include a zipper 150 that can be opened, and the core and cover 103 can be separated from one another such that the cover 103 can be separately washed.

Many different materials are possible for the cover, including for the first region and the second region. For example, materials such as cloth, polyester, cotton, blends, velour, mesh, and combinations thereof are possible. One example of a composite cover material according to the present disclosure can include hypoallergenic, antimicrobial, and/or odor protection technology, such as metallic fibers like silver fibers. Other types of fibers, such as plastic fibers and composite fibers, for example, are also possible. One such example of a composite material including metallic fibers that can be used in configurations of the present disclosure is the XT2® material available from Noble Biomaterials, which uses silver fibers. Such fibers can be blended with other cover materials that in some configurations are more traditional materials, such as those described above, to form the composite material. For example, one composite cover material includes approximately 80-99% traditional material (such as polyester, cotton, etc.), and/or approximately 1-20% fiber material (such as the XT2® silver fibers) by weight; or approximately 85-97% traditional material, and/or approximately 3-15% fiber material; or approximately 90-95% traditional material, and/or approximately 5-10% fiber material. Some configurations of cover material include 1% or more fiber material, 3% or more fiber material, 5% or more fiber material, 7% or more fiber material, or 10% or more fiber material. Some configurations of cover material include 20% or less fiber material, 15% or less fiber material, 10% or less fiber material, 7% or less fiber material, or 5% or less fiber material. Some configurations include approximately 7% fiber material.

Composite materials utilized in covers according to the present disclosure can have different densities, such as approximately 25-250 g/m2, or approximately 100-200 g/m2, or approximately 125-175 g/m2, or approximately 145 g/m2, or 25 g/m2 or higher, or 50 g/m2 or higher, or 100 g/m2 or higher, or 125 g/m2 or higher, or 300 g/m2 or lower, or 250 g/m2 or lower, or 200 g/m2 or lower, or 175 g/m2 or lower, or 150 g/m2 or lower. Many different configurations are possible, and it should be understood that the above ranges and numeric examples are for exemplary purposes only, and materials with properties outside these ranges are also possible.

Other materials are also possible. For example, one material that can be used in one or more regions of the cover is Dri-Lex®, available from Faytex Corp.; similar materials can also be used. Such materials can transfer heat and mass (e.g., moisture) out of the cover and/or redistribute them throughout the cover, as opposed to allowing heat or mass to gather in specific areas that may cause user discomfort, such as around the neck. Specifically, the Dri-Lex® Honeycomb P material can function well in this regard, as can other honeycomb materials as known in the art.

It is noted that the examples described above involve affixing the strap on one of the lobes. In alternative embodiments, the chin-supporting strap is removably attachable at opposing ends, and the front portion of both lobes includes an attachment region on each front portion to enable removable attachment of the opposing ends of the chin supporting strap.

It is further noted that the example structure depicted in the figures may not be to scale or may not fully illustrate examples of alternative structures. Fir example, the figures depict a strap 109 as having a width sufficient to support the user's chin. In an alternative embodiment, the chin-supporting strap comprises a width covering a substantial portion of an upper surface of the front portion of the two lobes when the chin-supporting strap is attached to the two lobes for use by the user in the manner described above. Similarly, the strap may include layered material having somewhat cushioning properties.

It is understood that various attributes and elements from any one configuration can also be included in other configurations. Although the present disclosure has been described in detail with reference to certain preferred configurations thereof, other versions are possible. The actual scope of the disclosure encompasses not only the disclosed configurations, but also all equivalent ways of practicing or implementing the disclosure. The above detailed description of the configurations of the disclosure is not intended to be exhaustive or to limit the disclosure to the precise form disclosed above or to the particular field of usage mentioned in this disclosure. While specific configurations of, and examples for, the disclosure are described above for illustrative purposes, various equivalent modifications are possible within the scope of the disclosure, as those skilled in the relevant art will recognize. The elements and acts of the various configurations described above may be combined to provide further configurations. Further, the teachings of the disclosure provided herein may be applied to products and systems other than travel pillows.

What is claimed is:

1. A travel pillow comprising:

a substantially U-shaped pillow body having a foam core and comprising two lobe portions spaced apart by a back portion connected at back-ends of the two lobe portions each lobe portion includes an outer surface and a front surface opposite the back portion;

raised portions extending from a base portion of the lobes and back portion, the raised portions configured to provide support for the user's head along both sides and a back side of the user's head when the travel pillow is positioned around the user's neck; and a chin-supporting strap affixed to a front portion of one of the two lobes and configured to extend to attach to the front portion of the other lobe, where when in use, the chin-supporting strap is extended to the lobe opposite the lobe to which the strap is affixed and removably attached to the opposite lobe, and where the chin-supporting strap is configured to support a user's chin when attached to the two lobes while in use by the user, thereby supporting the front side of the user's head.

2. The travel pillow of claim 1, where the chin-supporting strap is affixed at an affixing portion on the front portion of the lobe to which the chin-supporting strap is affixed, the chin-supporting strap extending from the affixing portion to an opposite end having a strap attachment mechanism configured to mate with a lobe attachment mechanism on the other lobe.

3. The travel pillow of claim 2, where the lobe opposite the lobe to which the chin-supporting strap is affixed includes an attachment region for supporting the lobe attachment mechanism on the lobe opposite the lobe to which the chin-supporting strap is affixed.

4. The travel pillow of claim 3, where the lobe attachment mechanism on the opposite lobe includes a hook and loop surface covering the attachment region, the hook and loop surface configured to mate with the strap attachment mechanism, where the strap attachment mechanism includes a corresponding hook and loop surface on a bottom surface of the chin-supporting strap.

5. The travel pillow of claim 2 where the affixing portion of the chin-supporting strap is on the outer surface of the lobe to which the chin-supporting strap is affixed.

6. The travel pillow of claim 2 further comprising:

a pocket mounted on one of the lobes.

7. The travel pillow of claim 6 where the pocket is mounted on the lobe to which the strap is affixed in sufficient proximity to receive the chin-supporting strap when not in use.

8. The travel pillow of claim 6 where the pocket is mounted to contain the affixing portion of the chin-supporting strap.

9. The travel pillow of claim 1, further comprising:

a cover enclosing the pillow body.

10. The travel pillow of claim 9 where:

the cover comprises an anchor mechanism to attach the cover of the pillow body to a headrest.

11. The travel pillow of claim 10 where:

the pillow body and the cover comprise two lobe cover portions spaced apart by a back cover portion connected at back-ends of the two lobe cover portions.

12. The travel pillow of claim 11 where:

the anchor mechanism comprises a first anchor body and a second anchor body to attach the cover of the pillow body to the headrest.

13. The travel pillow of claim 12 where the first anchor body and the second anchor body are angled outwardly relative to one another.

14. The travel pillow of claim 12, in which the first anchor body comprises a first end connected at a first side of the back portion of the cover, and the second anchor body comprises a first end connected at a second side of the back portion of the cover, opposite the first side.

15. The travel pillow of claim 12, in which the first anchor body and the second anchor body comprise at least one of a strap, a cord, a wire, a string, and a rope.

16. The travel pillow of claim 1 where the chin-supporting strap comprises a width substantially covering an upper surface of the front portion of the two lobes when the chin-supporting strap is attached to the two lobes for use by the user.

17. The travel pillow of claim 1 where the chin-supporting strap is removably attachable at opposing ends and the front portion of both lobes includes an attachment region on each front portion to enable removable attachment of the opposing ends of the chin supporting strap.

* * * * *